US006398694B1

(12) United States Patent
Bountourakis

(10) Patent No.: US 6,398,694 B1
(45) Date of Patent: Jun. 4, 2002

(54) PORTABLE EXERCISING DEVICE

(76) Inventor: Charalabos A. Bountourakis, 75 Giakoumaki Street, Heraklion Crete 71305 (GR)

( * ) Notice: Subject to any disclaimer, the term of this patent is extended or adjusted under 35 U.S.C. 154(b) by 0 days.

(21) Appl. No.: 09/530,189

(22) PCT Filed: Sep. 6, 1999

(86) PCT No.: PCT/GR99/00033

§ 371 (c)(1),
(2), (4) Date: Apr. 27, 2000

(87) PCT Pub. No.: WO00/13752

PCT Pub. Date: Mar. 16, 2000

(30) Foreign Application Priority Data

Sep. 8, 1998 (GR) ..... 980100334

(51) Int. Cl.[7] ..... A63B 23/14; A63B 23/16

(52) U.S. Cl. ..... 482/44; 482/45; 482/46; 482/109; 601/134; 601/135

(58) Field of Search ..... 482/12, 16, 18, 482/34, 38, 45, 46, 44, 106–109, 907–8, 115; 601/19, 134–5

(56) References Cited

U.S. PATENT DOCUMENTS 2,209,465 A * 7/1940 Matysek
4,606,539 A * 8/1986 Farnham ..... 272/93
4,648,387 A * 3/1987 Simmons ..... 128/57
4,695,049 A * 9/1987 Ciemiega ..... 272/67
5,445,581 A * 8/1995 Ferber ..... 482/46
5,709,630 A * 1/1998 Froelich, Sr. et al. ..... 482/46
5,709,635 A * 1/1998 Denison ..... 482/108
5,830,110 A * 11/1998 Fielding ..... 482/44

* cited by examiner

*Primary Examiner*—Michael A. Brown
*Assistant Examiner*—Lori Baker Amerson

(57) ABSTRACT

A portable, multi-faceted exercising and massaging device with adjustable turning resistance, having a stationary handle affixed to one end of the main shaft and a pressure adjusting handle with an orifice and axial screw threading affixed to the other end of the main shaft with a safety nut and two systems for receiving pressure between the inner rims of the bail bearings and handles. Around the main shaft are attached two external tubes with the mentioned ball bearings within the remote ends and joined at the adjacent ends through the central core, which is comprised of a tubular shaft with a central sleeve and connecting ring firmly attached at its middle onto the shaft, of two resistance sleeves and of two pairs of washers. This construction of the central core enables the exterior tubes with their shells, to rotate either freely around the main shaft as a single tube for massage use, or as independent tubes with adjustable resistance of their relative turning around the tubular shaft for exercising wrist, arm and upper body muscles. Near the handles are the receiving rings onto which is attached the adjustable elastic band, useful for both pressure-controlled massaging of the body areas it surrounds, as well as for tension and weight exercises of most body muscles.

10 Claims, 8 Drawing Sheets

PORTABLE EXERCISING DEVICE

SUMMARY

The present invention refers to an independent multi-purpose portable exercising device for exercising all muscle groups of the body, comprising two identical exterior tubes that revolve in relation to one another with resistance which can be adjusted through the central core, which core together with other attachments enters into their adjacent ends, while they revolve by the means of bearings, freely around the main shaft, which shaft has handles on its ends and other intervening attachments for attaching the adjustable elastic band, for various exercises with, or without it.

The present invention has as its primary purpose the provision of a handy, inexpensive, independent portable exercising device of small size and weight, for exercising all muscle groups of the body, in various positions such as lying down, seated, standing, even while in motion, utilizing various techniques and in combination with massaging, or for massaging only of all parts of the body.

The present invention refers to an independent multi-purpose portable exercising device for exercising all muscle groups of the body. It is well known that good health requires physical exercise and loss of excessive weight.

There are many different exercising devices which can be classified into various categories depending on the muscles they exercise and the way by which they accomplish it. In an exercising facility for example, there is a wide variety of devices and mechanisms, most of which are characterized by their large size, heavy weight, permanence of installation, complexity of construction and high cost. All of these, along with the difficulties of frequenting exercising facilities, (available time, scheduling, transportation, and costs), make such instruments and devices accessible only to very few people.

Permanently installed exercising devices are useful only at a specific location, which usually requires substantial space, while their capabilities are in most cases, limited. Resistance forces are usually provided by weight systems which are adjusted by adding or removing weights, as well as by systems with brakes or friction mechanisms which function in one direction only.

Portable exercising devices could be divided into two other groups: the dependent devices, which depend on some basis for support, such as floors, tables, door openings, etc. and the independent devices, which do not require any support base.

Dependent devices can be of solid construction, foldable and/or modular for transportation and storage. Even these devices are usually large and heavy, complex and costly, while they require a specific location for usage. In addition, most of them have very limited capabilities, such as exercises only for abdominal muscles, only for hands, only for wrists, only for thigh muscles and so on.

The independent portable devices are usually simpler, smaller, lighter and correspondingly inexpensive, such as rope systems, springs, coils, weight systems etc. Even those are specialized and have limited capabilities, such as exercises only for fingers, only for wrists, only for hands and so on.

Using weights creates many problems such as the necessity of different weights for different people and each exercise, while the variety of separate weights increases the cost. Such problems, along with transportation and storage complications, make such devices difficult to use, while at the same time, their use includes risks of injury and permanent damage to the body.

Specifically, most of the known exercisers for abdominal muscles, are portable dependent devices. Such devices are usually for assisting sit-ups with lever mechanisms and can be positioned underneath the body when in the supine position, supporting the head, the back even the legs One existing independent portable-exercising device for abdominal muscles is comprised of the main body in the form of an equal-sided triangle having indentations for handles, while at its base there fits an arm directed towards the top of the triangle, which arm has at its free end, a support pad that is perpendicularly attached to the arm, compressing springs which bring it back to its resting position and is used in a seated or standing position.

When the support pad is leaning against the abdominal muscles and the main body is pulled towards the abdomen, the pressure exerted by the_pull of the hands is diffused on the abdominal muscles through the relatively large surfaced support-pad, resulting in having to use a lot of pulling force in order to achieve just a little pressure per square centimeter, making thus the exercise tiresome and unpleasant.

At the level of the state of the art of the existing exercising devices, mainly for the wrist and hand, some are described in the following patent applications: EP 0401417 A1, EP0469363 A1, U.S. Pat. No. 5,364,324. In the related plans, it is evident that the handle-turning resistant forces mechanism is based on a clutching system where the friction discs are perpendicular to the device's axis and their surfaces are relatively small.

This means that a great amount of compressing force needs to be exerted on the resistance-controlling components, resulting in their wearing out. In order for the handles to turn in relation to one another without forcing the various components which are in between the friction discs to turn with them, variously shaped components are required, such as hexagonal, semi-circular etc., making their construction even more complex.

In addition, due to the fact that the mechanisms for regulating resistance are adjacent to the turning handles, it is possible that they could become deregulated when in use, while the risk of unintended disassembly during the adjustment procedure, also exists.

Another disadvantage in some of these devices, is that the regulation of resistance is independent in each handle, as in U.S. Pat. No. 5,364,324, meaning that sliding is achieved only on one side because of the great difficulty of achieving exactly the same regulation on both sides, which results in one-sided functioning, with more wear and tear.

One other drawback in some devices are the weights which are used, while in some others there exists the drawback of having their handles perpendicular to their axis, limiting thus the handgrip into only one position and at the same time limiting the field of exercising, while requiring in addition, different gripping rings on the handles for different hands.

As in the patent applications EP 0380292 A1, and WO 95/10333, beyond the complexity, the dependency and the accessories necessary, which make the use of the device difficult, the major drawback is that wrist movement is limited.

From the known devices for massage, the category of electric ones have the obvious drawbacks of manufacturing costs, maintenance and running costs, the electric tension on the devices, their dependency on electricity, as well as the direct exposure of the body to electromagnetic fields.

As for the category of non-electric devices, it includes various forms such as elastic spheres with a relief surface, either independent or attached to a shaft, pieces of short length and wavy surface, revolving around a shaft with one handle, etc.

The above have major shortcomings such as: in the case of independent spheres, the pressure carried through the sphere to a specific area of the body, originates from another surface touching the sphere, such as the palm of the hand. The motion of the sphere on the area of applying the massage, is made by the same surface which pushes it and is very unstable and limited, while the surface area which touches is very small and the difficulty of holding the sphere, is great.

In the case of the revolving spheres, or the small, wavy-surfaced pieces revolving around a shaft, this shaft rubs the surface of their orifice, resulting in an abnormal motion around the shaft, in wear and tear, in shedding the particles of wear and tear, as well as in a limited sweep area.

BRIEF DESCRIPTION OF THE INVENTION

The present invention refers to an improved exercising device and has as its primary purpose the provision of a handy, inexpensive, independent portable exercising device of relatively small size and weight, for exercising all muscle groups of the body, with various techniques, in different positions and in combination with massaging, or only for massaging all parts of the body.

The invention is comprised of the main shaft of appropriate length, round which there attach two exterior tubes by the means of ball bearings fitted inside their remote ends, while the tubes are joined together at their adjacent ends through the central core which fits snugly into them.

The central core is comprised of the tubular shaft, the central sleeve, the connecting ring, the slip washers, the resistance sleeves and the pressure washers. On the tubular shaft, which is concentric with the central shaft without touching it, there is solidly attached at approximately its midway the central sleeve along with the connecting ring, which surrounds the central sleeve.

The slip washers, the resistance sleeves and the pressure washers are also positioned on the tubular shaft symmetrically to the central sleeve. The resistance sleeves are of tubular form and of relatively soft material which becomes distorted when pressure is exerted on it (elastic distortion).

The central core, along with the pressure tubes and the safety washers are enclosed by the exterior tubes, which rotate freely around the main shaft by the means of ball bearings, either as a single tube, or as independent tubes with adjustable resistance of their relative turning around the tubular shaft.

The resistance of the exterior tubes' revolution is controlled through the pressure-adjusting handle, which revolves as a nut around the screw-threaded end of the main shaft, while the stationary handle is affixed on its other end.

The resistance of the exterior tubes' relative turning, depends on the pressure carried by the two handles on the resistance sleeves through the intervening components, which are: the receiving rings, the protection washers, the safety rings, the ball bearings, the safety washers, the pressure tubes and the pressure washers.

The safety nut is firmly screwed onto the end of the main shaft and is inserted into the hole of the pressure-adjusting handle. On the surface around the safety nut-receiving orifice, there are gradations which, in combination with the indicator on the safety nut, give a visual indication of the relative turning resistance of the exterior tubes.

Onto the exterior tubes are fitted the shells, for a steady grip during exercising that utilizes the exterior tubes' turning resistance, as well as for more effective massaging.

Onto the receiving rings is fitted the adjustable elastic band, which is comprised of the pulling elastic cord, the flexible protective hose and the hook together with the clamp.

The invention's advantages which are based on its characteristics, are the following:

The independent portable exercising device, is easily carried, having length that does not exceed 40 cm and weight of less than 800 gr., can be easily and inexpensively manufactured and does not need any supporting base. This means that the user can be in different positions and stances, such as lying down, seated, standing, even while in motion, combining various techniques during its use.

When the independent portable exercising device is used as a turning resistance device, the exterior tubes with their shells are used as handles that turn separately and in directions opposite to one another alternatively, then the device can provide isometric exercises for upper body muscles, such as chest muscles, arm, wrist, hand, fingers etc, with adjustable turning resistance.

Adjustment of the turning resistance is obtained by griping the stationary handle and correspondingly turning the pressure adjusting handle, without risk of unintentional disassembly (due to the safety nut), and risk of losing its adjustment while in use, having at the same time visual indication of the relative resistance when turning.

The relative turning resistance of the exterior tubes is caused mainly by the friction between the interior surface of the resistance sleeves and the exterior surface of the tubular shaft, where the smoothness of these surfaces makes their relative turning, even.

If pressure is exerted along the direction of the shaft at the ends of the resistance sleeves, it is carried to all points of the relatively extended friction-surface due to elastic distortion, so that, in order to reach the desired resistance in turning, little pressure is required, meaning less wear and tear on the threads of the main shaft, on the pressure-adjusting handle and on the components that carry the pressure.

The shape of the exterior tubes allows for gripping them firmly, permitting application of greater turning resistance for more intense exercising.

It is generally recognized that muscular stimulation from different angles, with different exercises and techniques, contributes substantially to effective exercising. In the present invention, this is accomplished through the alternative positions of the hands on the exterior tubes, such as thumbs inwards, thumbs outwards, one thumb inwards—one thumb outwards, hands in front, hands in back, hands extended, hands pulled and hands twisted, with capabilities of relative turning of the exterior tubes, up to 720 degrees.

During the relative turning of the exterior tubes, because of friction between the various surfaces, mainly the surface of the tubular shaft against the resistance sleeves, heat is produced and carried to the exterior tubes mostly in the area of the resistance sleeves (heat zone/warm area) and can be useful in low temperatures for warming up hands, feet etc.

When the device is used for massaging, the exterior tubes, having resistance in their relative turning, behave as a single tube which, through the ball bearings, rotates freely around the main shaft with minimal friction and wear.

When the device is held by the exterior handles, it can roll steadily and evenly on any area of the body, with absolute control of the pressure, as well as sweep over a large area of the body because of its length and in combination with the molded shape of the exterior tube shells, it provides a pleasant massage on all parts of the body, with the commonly known beneficial results.

The adjustable elastic band attaches with a noose onto one receiving ring more firmly, while it attaches onto the other with the hook, in such a way that it forms a closed loop, encircling the chosen body area (back, buttocks, thighs etc) with adjustable pressure.

During exercises for mainly the abdominal, posterior and thigh muscles, the device combines the exercising of the muscles, with intense massaging. Holding the device's exterior handles and rolling it back and forth on the tense muscle group, serves a dual purpose: both muscle invigoration, as well as absorption/diffusion of accumulated fat.

The adjustable elastic band may be replace by one or more pulling elastic cords in various combinations (parallel—in series etc), of corresponding length so that when it is positioned under the feet and the device is held by the hands, it can be used for various exercises of corresponding difficulty, even replacing light and heavy weights without problems related with weight use.

BRIEF DESCRIPTION OF THE DRAWINGS

For a better comprehension of the invention and its applications, there is reference to the attached drawings, which depict the following.

REFERENCE TO THE DRAWINGS

Figure 1:
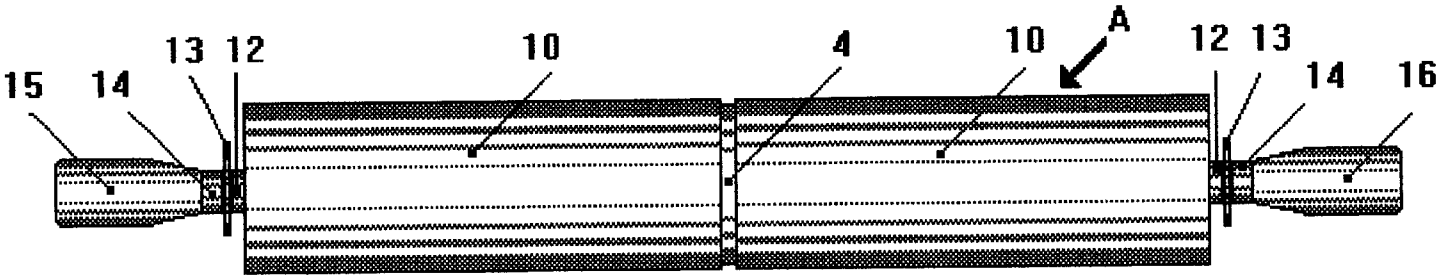
FIG. 1 is a perspective view of the main device (A).

1. Main shaft
2. Tubular shaft
3. Central sleeve
4. Connecting ring
5. Slipping washers
6. Resistance sleeves
7. Pressure washers
8. Pressure tubes
9. Safety washers
10. Exterior tubes
11. Ball bearings
12. Safety rings
13. Protective washers
14. Receiving rings
15. Stationary handle.
16. Pressure adjusting handle
17. Safety nut
18. Exterior tube shells
19. Pulling elastic cord
20. Flexible protective hose
21. Clamp.
22. Hook
23. Noose
24. Compound exterior tube

DETAILED DESCRIPTION

In reference to the drawings, various methods of applying the invention can be described in detail.

Figure 3:
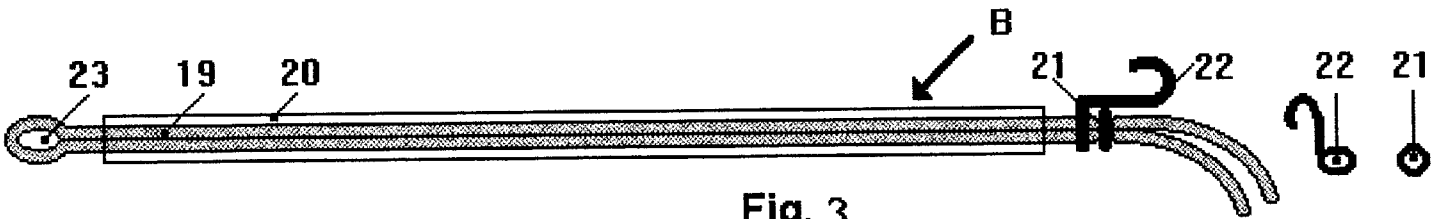
FIG. 3 depicts the adjustable elastic band (B).
Figure 4:
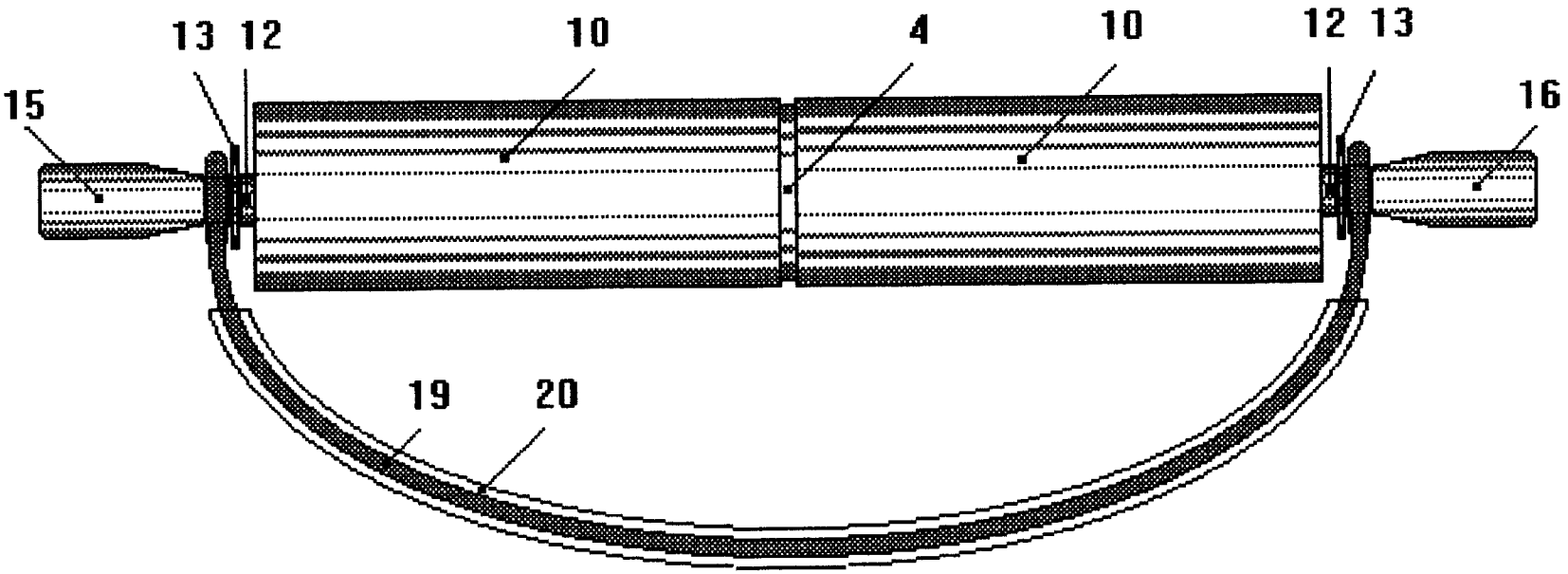
FIG. 4 is the depiction of FIG. 1, with the adjustable elastic band (B), attached onto it.
Figure 5:
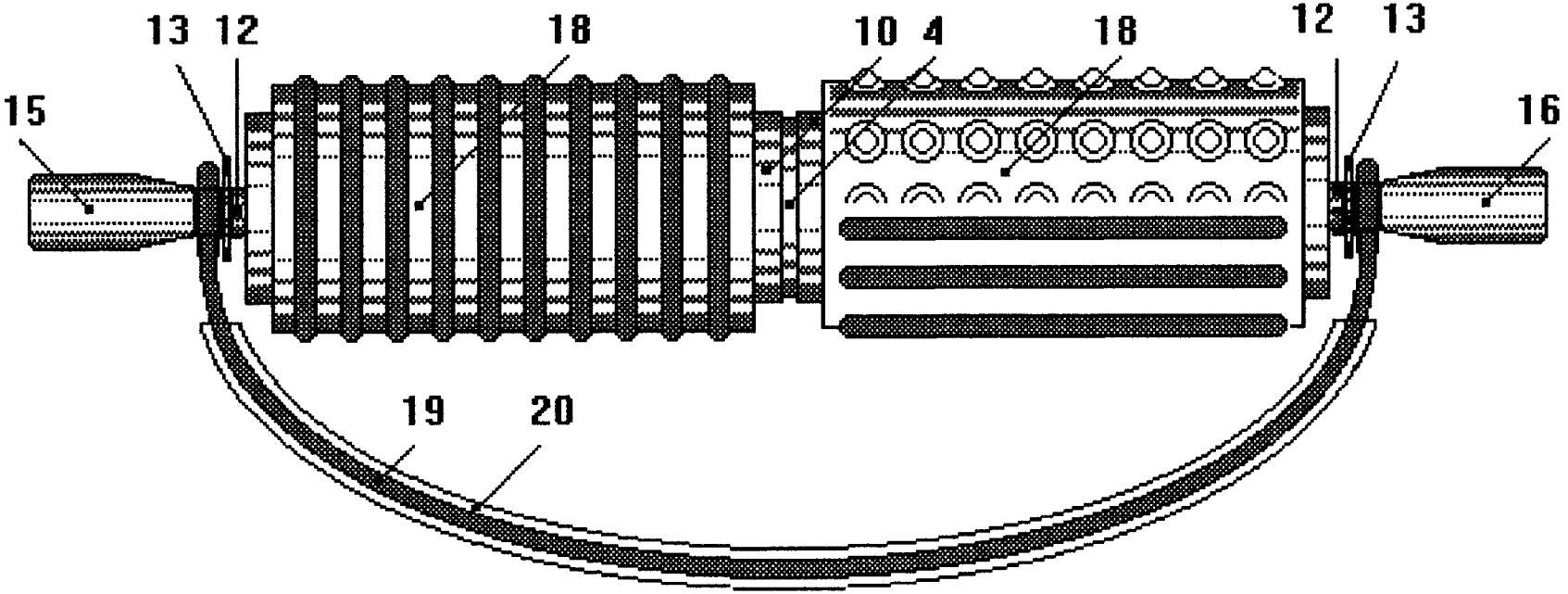
FIG. 5 is the depiction of FIG. 2, with the adjustable elastic band (B), adapted onto the device.
Figure 6:
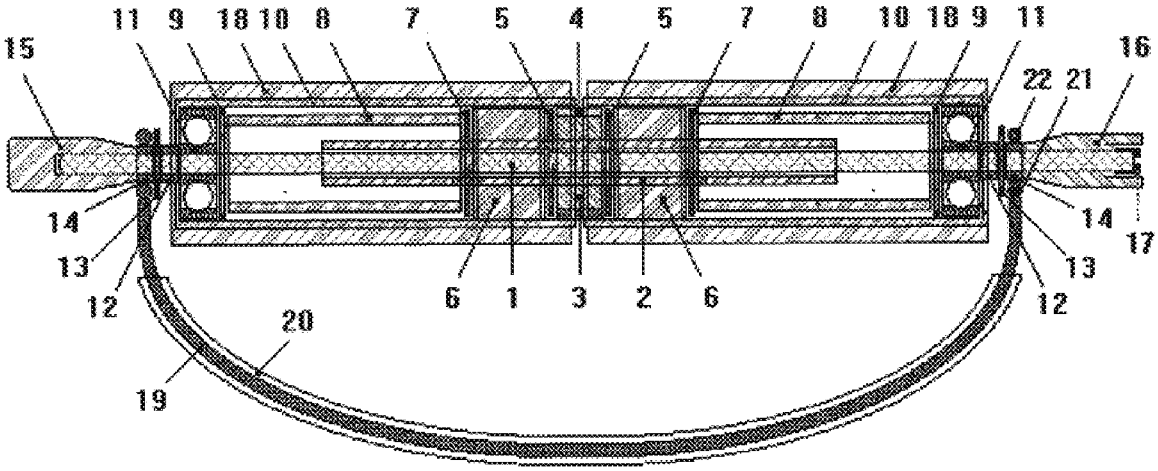
FIG. 6 is a cross-sectional view of the main device (A') taken from FIG. 2.

The independent multi-purpose portable exercising device is comprised of the main device (A), FIG. 1 and the adjustable elastic band (B), FIG. 3.

The main device (A), is comprised of the main shaft (1) of appropriate length, onto which there are circularly attached by means of ball bearings (11), two metallic exterior tubes (10). The exterior tubes (10) are positioned axially next to each other and have firmly attached into their remote ends, one ball bearing (11) each, while into their nearest ends fits snugly the central core (C), which connects them in such a way so that they can freely rotate in relation to the main shaft (1) by means of ball bearings (11), either as a single tube, or as independent tubes with adjustable turning resistance as they turn in opposite directions.

Figure 9:
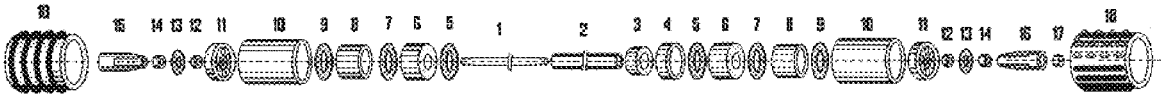
FIG. 9 is a minimized version of FIG. 8, in linear arrangement.
Figure 10:
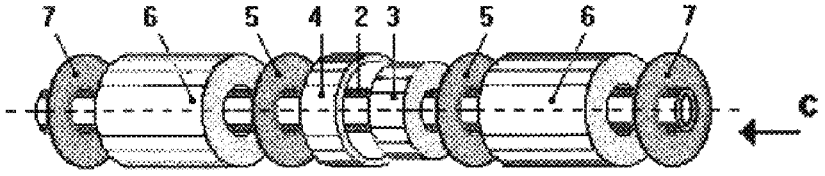
FIG. 10 is an exploded view of the central core (C) with a 3-dimensional depiction of the components which are attached to the tubular shaft.
Figure 11:
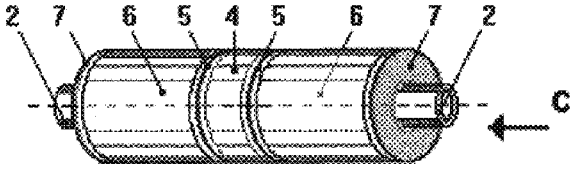
FIG. 11 is a condensed depiction of FIG. 9.

The central core (C) as shown in FIGS. 9 and 10, is comprised of a tubular shaft (2) which is of appropriate length and is concentric with the main shaft (1), as well as an interior diameter bigger than that of the main shaft (1), so that when they rotate once they are assembled, they do not touch one another.

Approximately in the middle of the tubular shaft (2) and around it, is attached the central sleeve, having tubular form and relatively short length and made from any of a variety of materials, such as rubber, plastic, metal etc.

The connecting ring (4) protects the central sleeve (3) by surrounding it and is made of the same material as the exterior tubes (10), fitting with some tolerance into their nearest ends, so that there is uniformity of materials at the connection, while this is not necessary when the central sleeve is metallic and of the same material as the exterior tubes.

The central sleeve (3), together with the connecting ring (4), are firmly attached onto the tubular shaft (2) and are useful in both holding this shaft in position, as well as in serving as seats for the slip washers (5).

Next, the various pairs of attaching parts—which have matching numbers-, are attached in the following sequence: Slip washers (5)—Resistance sleeves (6)—Pressure washers (7).

The resistance sleeves (6) can be made from a variety of soft materials such as rubber or plastic tubing, leather etc, so that as the resistance sleeves (6) are pressed they are distorted (elastic distortion).

The resistance sleeves (6) are axially interposed between the slip washers (5) and the pressure washers (7) and diametrically interposed between the external surface of the tubular shaft (2) and the internal surface of the corresponding sections of the exterior tubes (10).

The slip washers provide a surface for the central sleeve (3) and resistance sleeves (6) to slip on, both for their smooth revolution, as well as for their protection from direct friction.

If pressure is exerted along the shaft onto the pressure washers (7), the length of the resistance sleeves (6) will shorten, while their diameter will increase due to elastic distortion.

This will consequently result in the increase of friction, on one hand between the external surface of the tubular shaft (2) and the internal surface of the resistance sleeves (6) and on the other hand, between the external surface of the resistance sleeves (6) and the corresponding sections of the internal surface of the exterior tubes (10).

The increase in friction also means increase of the turning resistance of the exterior tube (10) in relationship to the tubular shaft (2) and as a consequence, in relationship to each other.

Figure 12:
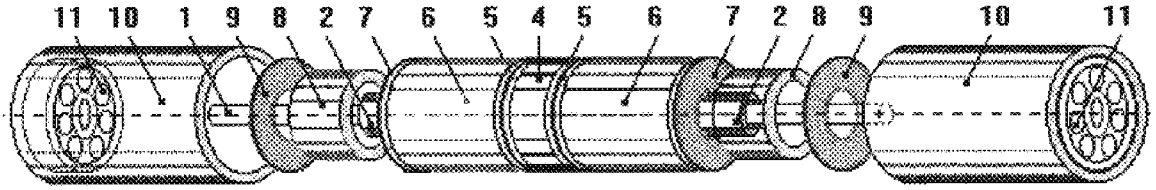
FIG. 12 is an exploded view of all the parts enclosed within the exterior tubes of the main device, with the ball bearings positioned at the ends of the exterior tubes and the main shaft in its intended position.

FIG. 12 shows the central core (C) along with the pressure tubes (8) and the safety washers (9) which are enclosed in the exterior tubes (10) together with the main shaft (1) inserted into the tubular shaft (2).

The pressure tubes (8) can be either metallic or of hard material of appropriate strength and of such diameter that they do not touch the tubular shaft (2), while their ends touch on one side the pressure washers (7) and on the other side the safety washers (9).

The safety washers (9) touch with their other flat side, only the outer rim of the ball bearings (11). The main shaft (1) goes through the centers of the ball bearings (11) with minimal tolerance, as well as through the tubular shaft (2), without touching it.

Onto the protruding parts of the main shaft (1), are affixed the two systems for receiving and carrying pressure, which are comprised of the following attachments in the following sequence: safety rings (12), safety washers (13) and receiving rings (14).

The internal diameter of the above attachments is approximately equal to the inner rim diameter of the ball bearings (11), so that they also move freely on the main shaft (1).

The safety rings (12) keep the protective washers (13) at a safe distance so that they do not touch the exterior tubes (10) and the ball bearings(11) thus holding the adjustable elastic band (B) in its proper position.

Onto the one threaded end of the main shaft (1), the stationary handle (15) is affixed, either tightly screwed, or integrated with it, while on the other threaded end, the pressure adjusting handle (11) revolves on the threading in a voluted way.

The pressure adjusting handle (16) has an axial orifice which is threaded on the inward part and is of larger diameter at the outward part so that the safety nut (17) can be freely inserted into it.

The safety nut (17) is a nut which is closed on one side (cap-nut) and has a tool-receiving end for tools such as screwdrivers, socket wrenches, Allen wrenches etc, so that it can be firmly tightened onto the end of the main shaft (1) and serves as a terminating stop for the pressure adjusting handle (16), when the handle turns counter-clock wise, thus eliminating the possibility of component disassembly without the use of tools.

When the pressure adjusting handle (16) turns around the main shaft (1), its distance from the stationary handle (15) varies because of the threading. As this distance lessens (turning clock wise), all the attachments move toward the central sleeve (3) and beyond a certain point they start being pressed between the stationary handle (15) and the pressure adjusting handle (16).

The pressure from the handles (15) and (16) is carried to the resistance sleeves (6) in the following order: Receiving rings (14)—protective washers (13)—safety rings (12)—inner rims of ball bearings (11)—balls of ball bearings (11)—outer rims of ball bearings (11)—safety washers (9)—pressure tubes (8)—pressure washers (7)—resistance sleeves (6)—slip washers (5) and central sleeve (3).

The above attachments can be grouped into two categories: the attachments related to the inner rims of the ball-bearings (11), which are the main shaft (1), the safety rings (14), the protective washers (13), the receiving rings (14), the stationary handle (15), the pressure adjusting handle (16) and the safety nut (17); and the attachments which are related to the outer rims of the ball-bearings (11), which are the exterior tubes (10) with or without their shells (18), the safety washers (9), the pressure tubes (8) and the central core (C), which is comprised of the tubular shaft (2), the central sleeve (3), the connecting ring (4), the slip washers (5), the resistance sleeves (6) and the pressure washers (7).

These two groups of attachments are connected to each other through the ball-bearing (11), in such a way that the second group can revolve freely and independently of the first group, mainly around the main shaft (1). This means that the exterior tubes can revolve freely around the main shaft (1) both as a unified single exterior tube, as well as two independent exterior tubes (10) with adjustable resistance of turning one opposite the other (relative turning) and independently of it.

The relative turning resistance of the exterior tubes (10), is controlled through the pressure adjusting handle's (16) volute turning on the main shaft (1), axially varying the pressure on the resistance sleeves (6).

Turning the exterior tubes (10) in any way, does not affect the pressure adjusting handle's (16) position on the main shaft (1) because of the ball-bearings, so the selected turning pressure adjustment remains unchanged.

Figure 7:
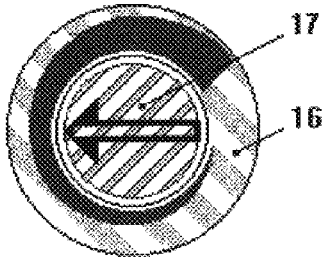
FIG. 7 is a lateral view of the pressure-adjusting handle, with gradations and safety nut for the relative indication of the exterior tube turning resistance.
Figure 8:
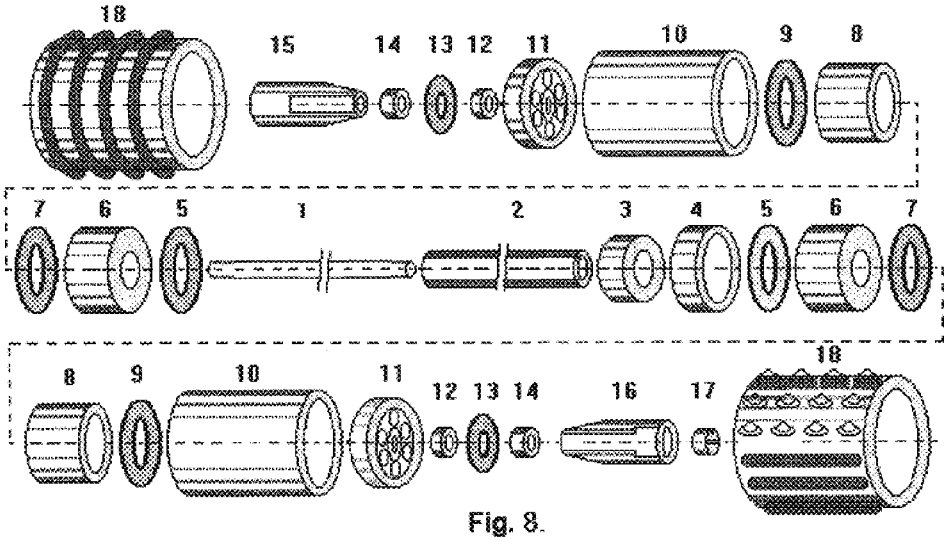
FIG. 8 is an exploded view of the device and shows the relative order of the components in FIG. 6, disassembled in a 3-dimensional depiction.

On the external surface of the pressure adjusting handle (16) and around the orifice into which the safety nut (17) is inserted, FIG. 7, there can be a scale for indicating the level of resistance, with gradations around the hole, so that reference to an indicator on the visible part of the safety nut, gives a visual depiction of the pressure adjusting handle's position (16) in relation to the main shaft (1) and to the stationary handle (15), as well as an indication of the relative turning resistance of the exterior tubes (10).

The exterior tubes (10) are used as the main handles for isometric exercises of the wrists and other muscle groups of the upper body, which exercises are based on the adjustable resistance of the relative turning of the exterior tubes (10).

Figure 2:
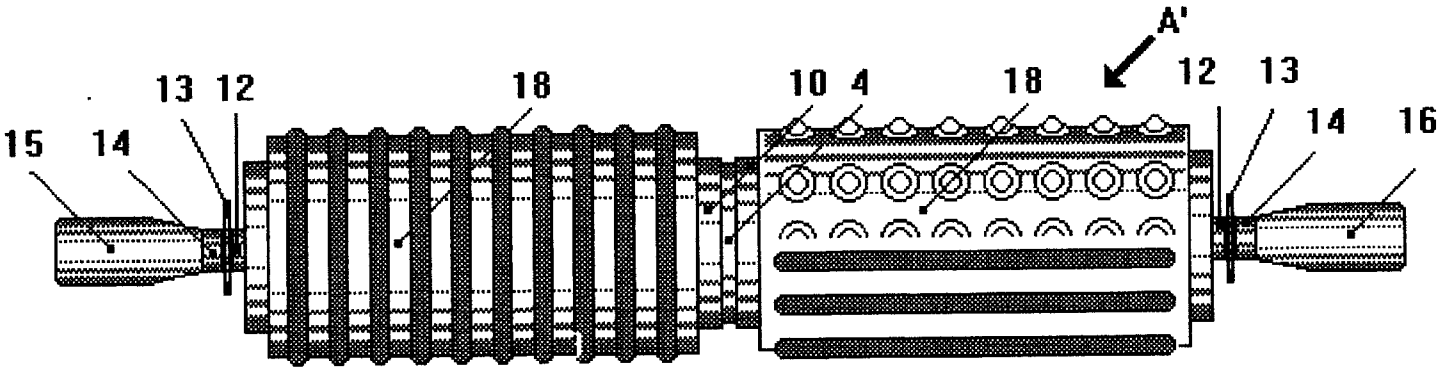
FIG. 2 is a perspective view of the main device (A') which is the depiction of FIG. 1, with the various shapes and profiles of the shells, put onto the exterior tubes for gripping, as well as for massaging.

Onto the external surfaces of the exterior tubes (10), there can be affixed the shells (18), FIG. 2, of various shapes and forms which both facilitate firm gripping of the exterior tubes (10) so that the hands do not slip on them, as well as function as surfaces which press and massage muscles and all parts of the body in general.

The adjustable elastic band (B) FIG. 3, is comprised of a round pulling elastic cord (19) which could be folded in two, either at one of its ends, or in the middle and inserted into a clamp (21) serving as a terminating stop on the hook's ring (22), into which the pulling elastic cord (19) is inserted.

Next, the pulling elastic cord (19) is inserted into the flexible protective hose (20) in such a way that, the folded end of the pulling elastic cord (19) is protruding out of one end of the hose, forming a noose (23), while the free end or ends of the pulling elastic cord (19), together with the clamp (21) and the hook (22), are protruding out of the other end of the flexible protective hose (20).

The adjustable elastic band (B) is attached to the receiving rings (14) which are part of the systems for receiving and carrying pressure of the main device (A), on one end by passing one of the receiving rings (14) into the noose (23) and on the other end by clasping the hook (22) on the other receiving ring (14), so that a closed loop is formed.

This loop can encircle various parts of the body such as the back, the waist, the thighs etc, exercising the muscle groups of these parts in combination with kneading mainly the fat accumulated around these muscles, with adjustable tension. The tension is adjusted by repositioning the clamp (21) along the length of the pulling elastic cord (19), altering so the effective length of the adjustable elastic band. (B).

The clamp (21) can be any appropriate mean of constriction, such as clamp with bolt, with nut, clasp, buckle, spring system etc, which can constrict the pulling elastic cord (19), at the selected point.

The clamp (21) can also be a simple ring of small diameter in relation to the pulling elastic cord (19), such that it chokes it without moving along its length, unless the elastic cord is stretched taut, both before and after the ring.

The adjustable elastic band (B) can have any other shape or form, such as an elastic strap with means of attaching onto the receiving rings and a buckle for adjusting it. It can even be comprised of one or more pulling elastics cords (19) of appropriate length in various combinations (parallel—in series), for different exercises with corresponding levels of required effort, such as exercises that need weights etc.

Figure 13:
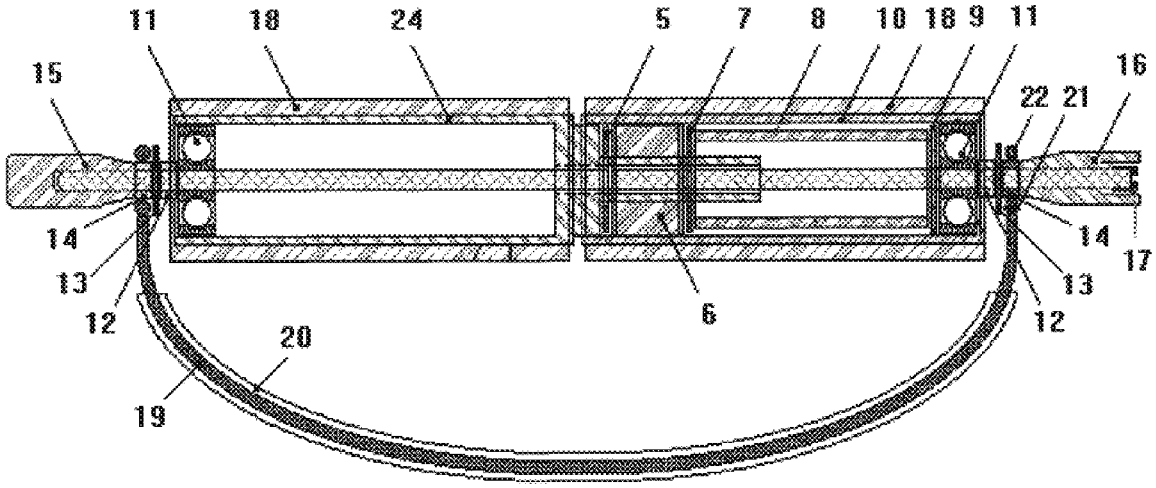
FIG. 13 is a cross-sectional view of another application of the invention with fewer parts.
Figure 14:
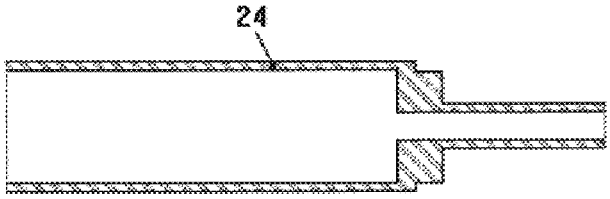
FIG. 14 is a cross-sectional view of the exterior tube in assembly with the central sleeve and the tubular shaft, all together comprising the compound exterior tube.

Another way of applying the invention is shown in FIG. 13, where the main device (A) is comprised of the two exterior tubes, one of which has Integrated onto one of its ends the metallic central sleeve (3), as well as the tubular shaft (2), so that together they make the compound exterior tube (24), as shown in FIG. 14.

Onto one end of the compound exterior tube (24), a ball-bearing (11) is affixed and no other attachments are enclosed in it, while at its other end protrudes part of the tubular shaft (2). Onto the tubular shaft (2) are put the slip washer (5), the resistance sleeve (6) and the pressure washer (7), together comprising the central core (C). The central core (C) is inserted into the adjacent end of the exterior tube (10) which contains it, together with the pressure tube (8), the safety washer (9) and the ball-bearing (11).

All remaining attachments are identical to those of the previous application, such as the main shaft (1), safety rings (12), protective washers (13), receiving rings (14), stationary handle (15), pressure adjusting handle (16), safety nut (17) and exterior tube shells (18). The attachments common to both applications of the invention described above, have the same characteristics, collaborate and function in both applications as already described.

The two applications can be utilized in the same manner, either with the adjustable elastic band (B), or without it.

Figure 15:
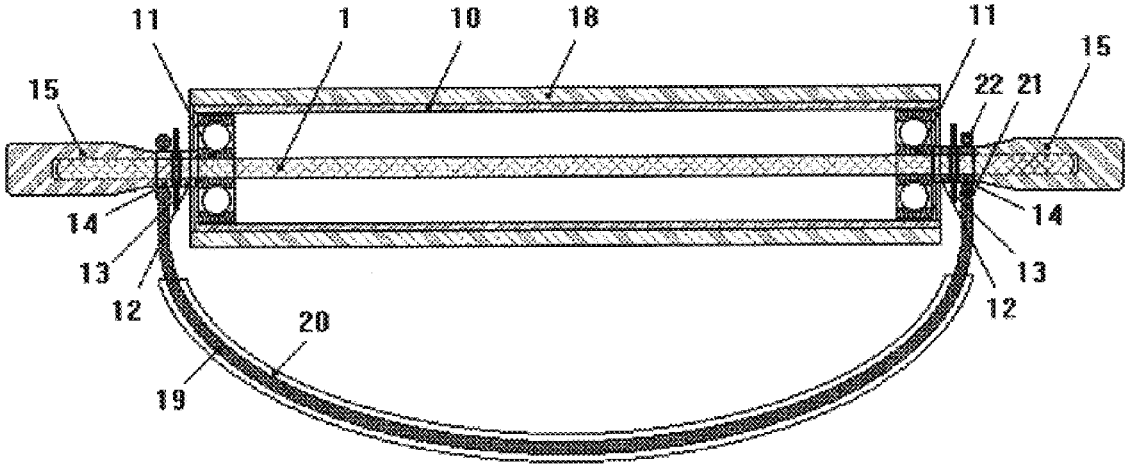
FIG. 15 is a cross-sectional view of a more simplified application of the invention.

Another more simplified application of the invention is depicted in FIG. 15. The main device (A) is comprised of the main shaft (1), one exterior tube (10) with two ball-bearings (11) affixed into the interior of its ends, the safety rings (12), the protective washers (13), the receiving rings (14), two stationary handles (15) and one exterior tube shell (18).

Onto this simplified version of the main device (A), the adjustable elastic band (B) can be attached, allowing use of the device as previously described, with the exception of isometric exercises for wrists and upper body muscles, which are based on the exterior tubes' (10) relative turning resistance.

What is claimed is:

1. An independent multi-purpose portable exercising device for exercising all muscle groups of the body utilizing various techniques, in various positions in combination with massaging, or for massaging only of all parts of the body, comprising an elongated main shaft (1), two exterior tubes (10) axially positioned on the main shaft (1), two ball-bearings (11) affixed into the remote ends of the exterior tubes (10) and on the main shaft (1), a central core (C) inserted into the adjacent ends of the exterior tubes (10), which it joins and keeps supported, two pressure tubes (8) interposed between the outer rims of the ball-bearings (11) and the central core (C) and concentric with it, a stationary handle (15) which Is firmly affixed onto one end of the main shaft (1), a pressure-adjusting handle (16) with an orifice and axial screw-threading, which is affixed onto the other end of the main shaft (1), two systems for receiving and carrying pressure between the inner rims of the ball bearings (11) and the handles (15)–(16), a safety nut (17) tightly affixed onto the screw- threaded end of the main shaft (1) next to the pressure adjusting handle (16), two exterior tube shells (18) which surround the tubes, as well as an adjustable elastic band (B) which attaches onto the systems of receiving and carrying pressure.

2. The independent multipurpose portable exercising device of claim 1, is characterized by the main shaft (1), onto one end of which there is firmly affixed the stationary handle (15) integrated onto it, even screw-threaded, while around the other end which is screw-threaded, revolves the pressure adjusting handle (16) which is axially hollow and screw-threaded on the inward part, so that it can revolve in a voluted way around the thread of the free end of the main shaft (1), moving correspondingly on it, while the diameter of the outward part is such that the safety nut (17) enters freely into it and is firmly affixed with the use of a tool onto the screw-threaded end of the main shaft (1), serving as a terminating stop of the pressure adjusting handle when it is revolving counter clockwise on the main shaft (1), which shaft has diameter slightly smaller than the interior diameter of the attachments on it between the two handles (15)–(16), which attachments are the two ball bearings (11), the two safety rings (12), the two pressure washers (13), and the two receiving rings (14), so that they move freely on the main shaft (1) when they are compressed or depressed with the corresponding voluted revolution of the pressure adjusting handle (16) around the main shaft (1).

3. The independent multi-purpose portable exercising device of claims 1 or 2, is characterized by the pressure adjusting handle (16), having on its surface where the safety nut (17) fits into the hollow, an indicative scale with gradations around the hollow, which, when combined with the mark that the safety nut may have, provides a visual indication of the relative position of the pressure adjusting handle (16), when the handle revolves around the main shaft (1) and by extension, the related indication of turning resistance when the exterior tubes (10) are turning.

4. The independent multipurpose portable exercising device of claims 1 or 2, is characterized by the ball bearings (11) by the means of which the exterior tubes (10) rotate freely as to the main shaft (1) and the attachments affixed on it, such as the stationary handle (15) and the pressure adjusting handle (16), whose adjustment is carried to the central core (C) by the means of the bearings (11) without affecting the exterior tubes (10) revolution around the main shaft (1), while only their relative turning is affected and in addition, any revolution of the exterior tubes (10) has no effect on the pressure adjusting handle (16).

5. The independent multi-purpose portable exercising device of claims 1 or 2, is characterized by the two exterior tubes (10), which can be replaced by one exterior tube (10) without the attachments that are enclosed, as well as by the pressure adjusting handle (16) together with the safety nut (17), which together can be replaced by a second stationary handle (15).

6. The independent multipurpose portable exercising device of claim 1, is characterized by the central core (C) which is comprised of the tubular shaft (2), the central sleeve (3) which is firmly positioned approximately at the middle of the tubular shaft (2), the connecting ring (4) which surrounds the central sleeve (3), the slip washers (5) which are put on the tubular shaft (2) symmetrically as to the central sleeve (3) and to the connecting ring (4) and the resistance sleeves (6) which are put on the tubular shaft symmetrically, touching the slip washers at their nearest ends, while the remote ends of the resistance sleeves touch the pressure washers (7) which are put symmetrically onto the tubular shaft (2).

7. The independent multi-purpose portable exercising device of claim 6, is characterized by the resistance sleeves (6) that are in tubular form and are made of relatively soft material which becomes distorted when pressure is exerted on it (elastic distortion), while they occupy the space between the slip washers (5) and the pressure washers (7) axially and in between the tubular shaft (2) and the exterior tubes (10) diametrically, so that when they are axially compressed, the pressure is carried diametrically to the points of contact with the tubular shaft (2) and the exterior tubes (10), increasing the friction between them, as well as the resistance of their relative turning.

8. The independent multi-purpose portable exercising device of claim 1, is characterized by the shells of the exterior tubes (18), which surround the tubes with appropriately shaped surfaces for a steady grip during exercising with adjustable resistance from the relative turning of the exterior tubes (10), as ell as for more effective massaging.

9. The independent multipurpose portable exercising device of claim 1, is characterized by the elastic band (B) of adjustable length and tension, comprised of the pulling elastic cord (19) folded in the middle and forming a noose (23) at the folding point, with which it attaches onto one of the receiving rings (14) and which pulling elastic cord (19), may be replaced by one or more pulling elastic cords in various combinations (parallel—in series) and of corresponding length for different exercises such as exercises that require weights; also comprised of the flexible protective hose (20), the hook (22) and the clamp (21) which can be any means of constriction, such as a damp with bolt, with nut, with spring, with buckle etc, even a ring of appropriate diameter which strangles the pulling elastic cord (19) and can slide along its length, when the pulling elastic cord (19) is stretched taut both before and after the ring.

10. The independent multi-purpose portable exercising device of claims 1 or 4, is characterized by one of the two exterior tubes (10), the tubular shaft (2) and the central sleeve (3) which is metallic and all can be integrated into one unit, so as to comprise the compound exterior tube (24).

* * * * *